United States Patent [19]

Arens

[11] Patent Number: 4,572,397

[45] Date of Patent: Feb. 25, 1986

[54] CONTAINER FOR CHEMICALS

[75] Inventor: Hans Arens, Wertingen, Fed. Rep. of Germany

[73] Assignee: Grunbeck Wasseraufbereitung GmbH, Hochstadt, Fed. Rep. of Germany

[21] Appl. No.: 695,737

[22] Filed: Jan. 28, 1985

Related U.S. Application Data

[63] Continuation of Ser. No. 477,227, Mar. 21, 1983, abandoned.

[30] Foreign Application Priority Data

Mar. 24, 1982 [DE] Fed. Rep. of Germany ..... 3210819

[51] Int. Cl.[4] ..... A01G 9/02

[52] U.S. Cl. ..... 220/270; 220/366; 220/373; 220/85 F; 215/248; 215/307; 215/308

[58] Field of Search ..... 220/270, 366, 373, 85 F; 215/248, 307, 308

[56] References Cited

U.S. PATENT DOCUMENTS

| | | | |
|---|---|---|---|
| Re. 21,699 | 1/1941 | Monnier | 215/248 |
| 2,665,326 | 1/1954 | Knight | 220/373 X |
| 3,282,477 | 11/1966 | Henchert | 220/270 X |
| 3,952,902 | 4/1976 | Prouty et al. | 215/308 X |
| 4,133,462 | 1/1979 | Lindström | 215/307 X |
| 4,231,489 | 11/1980 | Malone | 220/366 X |
| 4,358,908 | 11/1982 | Song | 220/366 X |

FOREIGN PATENT DOCUMENTS

| | | | |
|---|---|---|---|
| 684182 | 11/1939 | Fed. Rep. of Germany . | |
| 2629625 | 1/1985 | Fed. Rep. of Germany . | |
| 1540096 | 9/1968 | France | 220/85 F |

*Primary Examiner*—Steven M. Pollard
*Attorney, Agent, or Firm*—Donald Brown

[57] ABSTRACT

A dirt and bacteria tight connection between a container for chemicals and the suction pipe of a metering pump is disclosed, which may in particular be used for the treatment of drinking water. In this way it is achieved that only degerminated air may enter the interior of the container when sucking metering fluid from the container.

16 Claims, 4 Drawing Figures

CONTAINER FOR CHEMICALS

This application is a continuation of application Ser. No. 477,227, filed Mar. 21, 1983, now abandoned.

BACKGROUND OF THE INVENTION

The invention relates to a container for chemicals, which in particular shall be suitable for the use with a metering pump in the treatment of drinking water.

In the treatment of drinking water chemicals are added in dosed quantities mainly for decarbonisation and binding of aggressive carbon dioxide. To this end a container for chemicals is opened and a so-called chemicals suction head of a metering pump is entered into the container and the chemicals. When the chemicals are sucked out air will flow into the interior of the container in order to avoid a reduced pressure within the container, threby causing the danger of pollution and contamination.

OBJECTS OF THE INVENTION

It is the object of the invention to provide an improved container for chemicals. It is a further object of the invention to provide a container for chemicals which is designed such that pollution and contamination of the metering fluid by entering air is avoided.

SUMMARY OF THE INVENTION

In accordance with the invention, the container for chemicals has a portion forming an opening for receiving a tube adapted to be entered into the container and leading to a metering pump and a head piece connectable with that portion, wherein the head piece comprises sealing means surrounding the tube to be entered and there is provided an air path between the portion and the head piece, the air path ending in the interior of the container, and a filter connecting the air path with the interior of the container. Thus, only degerminated air may enter the container.

BRIEF DESCRIPTION OF THE DRAWINGS

Further features, objects and advantages of the invention will stand out from the following description of nonlimitative exemplary embodiments of the invention with reference to the drawings. In the drawings.

Figure 1:
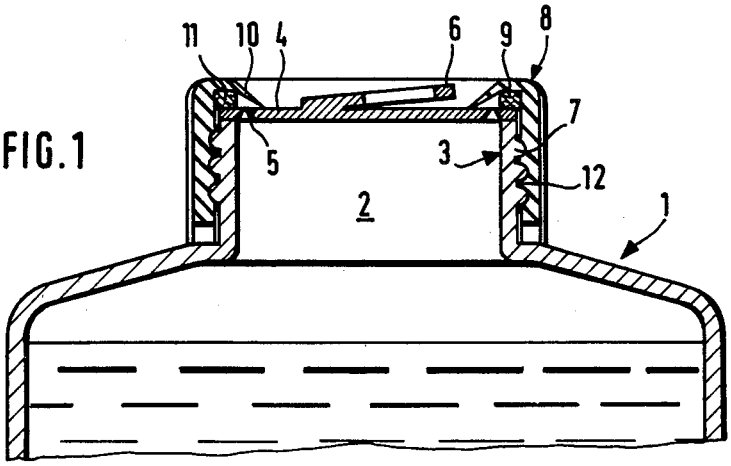
FIG. 1 is a sectional view of part of the container for chemicals according to a first embodiment of the invention.
Figure 2:
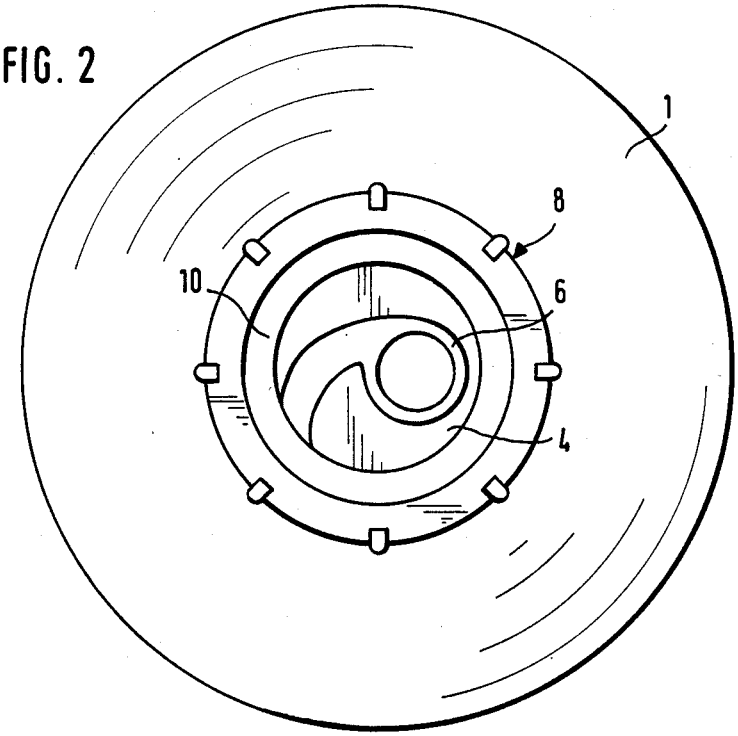
FIG. 2 is a plan view of the container shown in FIG. 1.
Figure 3:
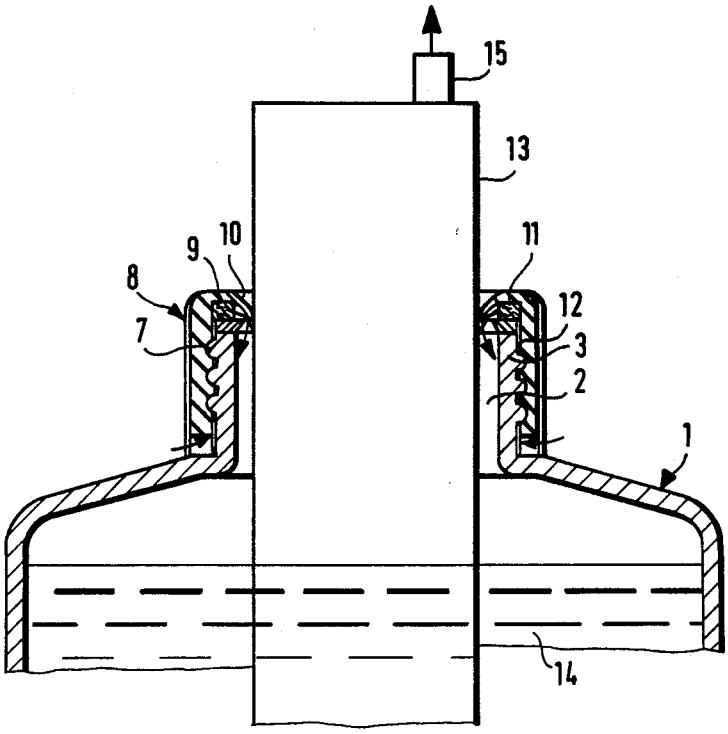
FIG. 3 is a sectional view of the container shown in FIG. 1 with entered suction pipe.

With reference to the FIGS. 1 to 3 a first embodiment of the invention shall be described. A container 1 for chemicals on its upper side comprises a neck 3 surrounding an opening 2. A tight tear-off cap 4 made of a material impenetrable for the contents of the container is welded to the upper end surface of the neck 3. The tear-off cap 4 comprises a weakening line 5 determining the tear-off sectional area as well as a rip ring 6, as usual with tear-off caps of that kind. By pulling the rip ring 6 the container is opened.

The neck 3 comprises an external thread 7, on which a head piece formed as a clamping nut 8 is screwed. The clamping nut 8 has an annular projection forming a stop 9 extending inwardly on that end thereof which is turned away from the container, as well as sealing means positioned inwardly adjacent thereto and formed as a sealing ring 10.

An annular dirt and bacteria filter 11 is disposed between the annular stop 9 and the outer surface of the tear-off cap 4. The filter 11 is tightly clamped in its position by means of the screwed-on clamping nut.

As may be best seen from the FIGS. 1 and 3 the external thread of the neck 3 and a corresponding internal thread of the clamping nut 8 are adapted in that manner relative to each other that there results a screw gap 12. The end of the screw gap facing the interior of the container is defined by the filter 9. Hence, air flowing through the screw gap 12 from the outside must pass the filter 11 and is thereby degerminated.

A it is shown in FIG. 1 the outer lip of the sealing ring 10 extends to the surface of the tear-off cap. By this means the filter 11 is covered against pollution from outside by the sealing ring 10 in the closed state of the container, and the sealing with respect to the contents of the container is provided for by the tear-off cap 4 itself.

In operation the tear-off cap 4 is opened by pulling the ring 6. Subsequently, the tear-off cap 4 is opened in a manner which can be best seen from FIG. 3, and a suction pipe 13 forming the suction head is entered through the opening 2 into the interior of the container and into the container contents 14 which are to be sucked into a metering means. In a known manner the suction pipe 13 leads to a metering pump via a sketched connection 15.

As may be best seem from FIG. 3 the sealing ring 10 has an internal diameter which is smaller than the external diameter of the suction pipe 13 to be entered. Thereby, the sealing ring is biased such that it tightly fits around the exterior of the suction pipe and thereby hermetically seals the opening 2 from the exterior. To this end the sealing ring preferably is made of a resilient material. The only connection between the interior of the container and the external atmosphere is formed by the screw gap 12. Whenever metering fluid 14 is sucked by the metering pump a reduced pressure is created which is evened out by air inflowing through the screw gap 12. Since the inflowing air passes the filter which is designed as a dirt and bacterial filter, the air is cleaned and degerminated such that the metering fluid 14 within the metering container is not polluted.

Figure 4:
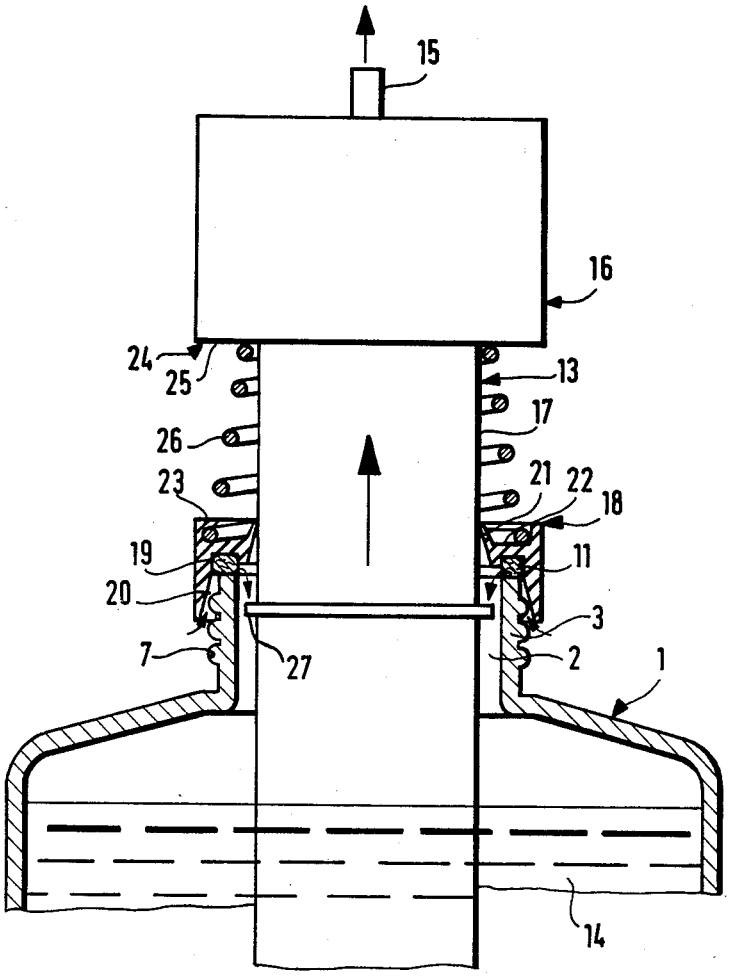
FIG. 4 is a sectional view of part of a container according to a different embodiment of the invention.

Practically, the embodiment shown in the FIGS. 1 to 3 is a disposable cap with a disposable filter. Contrary thereto an embodiment with a reusably designed cap and filter is shown in FIG. 4.

The container 1 for chemicals shown in FIG. 4 again comprises a neck 3 forming an opening 2 and having an external thread on its outer side. As long as the container is closed a cowling clip is screwed thereon. The suction head 16, which is connectable with the metering pump via the sketched connection 15, comprises a suction pipe 13 having a filter support ring 18 slidably provided on the peripheral surface thereof. In the embodiment shown the filter support ring 18 is designed in the manner of a cap adapted to be slipped on the thread. However, the ring may also be designed as a cap having an internal thread, whereby the filter support ring may be screwed on the external thread of the neck 3. The filter support ring has a groove 19 forming an annular stop on its lower surface facing the outer end surface of the neck 3. The groove 19 receives a dirt and bacteria filter 11. As in the first embodiment the filter 11 is firmly clamped by slipping or screwing, respectively, the filter support ring 18 onto the threaded external surface of the neck 3 in such a manner that again the filter terminates a screw gap 20 or air gap 20, respectively, existing between the external thread and the filter support ring towards the opening 2.

As in the embodiment described first also in the second embodiment there is provided a sealing ring 21 within the interior of the filter support ring 18, the sealing ring 21 having an internal diameter which is smaller than the external diameter of the suction pipe 13. Again the filter support ring 18 is made of a resilient material such that the sealing ring 21 tightly fits to the surface 17 of the suction pipe 13 and forms a hermetic connection.

An annular abutment 22 is formed on the surface 23 turned away from the container. Furthermore, the suction head 16 has a portion 24 having a diameter which is larger than the diameter of the suction pipe 13. The lower surface 25 of the portion 24 facing the container forms a second abutment 25 opposite to the abutment 22. A compression spring 26 is provided between these both abutments 22, 25. The compression spring 26 firmly presses the filter support 18 onto the container such that the filter 11 remains clamped in its position.

An annular projection 27 projecting from the surface 17 is provided at the outer surface 17 of the suction pipe 13. In such a distance from the lower surface 25 that the projection attains a position within the opening 2 in a distance from the filter support 18, as shown in FIG. 4, if the suction pipe is put on the container. If the suction head is removed from the container 1, then the annular projection 27 engages the filter support ring 18 and lifts the same together with the filter 11 clamped within the annular groove 19 out of the force fit upwardly off from the neck 3. Thus, the apparatus shown in this embodiment is a reusable apparatus.

Although the invention has been described with reference to specific example embodiments, it is to be understood, that it is intended to cover all modifications and equivalents within the scope of the appended claims.

What is claimed is:

1. Container for chemicals comprising a portion forming an opening for receiving a tube adapted to be entered into the container and leading to a metering pump and a headpiece connectable to the said portion, wherein said headpiece comprises sealing means surrounding the tube to be entered and wherein there is provided an air path passing between said portion and said headpiece, said air path ending in the interior of the container passing between said sealing means and said portion and a filter means connecting said air path with the interior of the container and closing means for closing said opening, said filter means being held between said portion and said headpiece in a position between said portion and said sealing means at the outside of said closing means, whereby said filter means is prevented from contact with the chemicals before opening said closing means for entering said tube.

2. Container of claim 1, wherein said sealing means is formed as a packing washer surrounding said tube to be received, said packing washer covering said filter means towards the exterior, and wherein said filter means is held between said portion and said head piece.

3. Container of claim 1 or 2, wherein said opening is sealed by a sealing element, which is impervious for said chemicals, and wherein said filter means is disposed on the outside of said sealing element.

4. Container of claim 3, wherein said sealing element comprises a rip ring and preferably a weakening portion for tearing open said opening.

5. Container of claim 1 or 2, wherein said head piece is designed to be slidable on said suction pipe and is depressed onto said portion by means of a compression spring.

6. Container of claim 5, wherein said opening is sealed by means of a sealing element, which is impervious for said chemicals, and wherein said filter means is disposed on the outside of said sealing element.

7. Container of claim 6, wherein said sealing element comprises a rip ring and preferably a weakening portion for breaking open said opening.

8. Container for chemicals having a portion forming an opening for receiving a tube adapted to be entered into the container and leading to a metering pump, a head piece connectable to said portion and comprising a radially inwardly extending annular projection and a sealing ring positioned inwardly adjacent thereto and surrounding said tube to be entered, wherein an air path is provided between said portion and said head piece, said air path leading from the exterior into the interior of said container and ending between said projection and said portion, and a filter means is disposed in said air path between said projection and said portion, thereby degerminating air entering said container through said air path.

9. Container of claim 8, wherein said sealing means is formed as a packing washer surrounding said tube to be received, said packing washer covering said filter means toward the exterior.

10. Container of claim 8 or 9, wherein said opening is sealed by a sealing element, which is impervious for said chemicals, and wherein said filter means is disposed on the outside of said sealing element.

11. Container of claim 10, wherein said sealing element comprises a rip ring and preferably a weakening portion for tearing open said opening.

12. Container of claim 8 or 9, wherein said head piece is designed to be slidable on said suction pipe and is depressed onto said portion by means of a compression spring.

13. Container for chemicals having a portion forming an opening for receiving a tube adapted to be entered into the container and leading to a metering pump and a head piece connectable to the said portion, wherein there is provided an air path between said portion and said head piece, said air path ending between said portion and said head piece, and filter means held between said portion and said head piece and connecting said air path with the interior of said container, and wherein said head piece comprises a packing washer surrounding said tube to be entered, said packing washer covering said filter means toward the exterior.

14. Container of claim 13, wherein said opening is sealed by a sealing element, which is impervious for said chemicals, and wherein said filter means is disposed on the outside of said sealing element.

15. Container of claim 14, wherein said sealing element comprises a rip ring and preferably a weaking portion for tearing open said opening.

16. Container of claim 13, wherein said head piece is designed to be slidable on said suction pipe and is depressed onto said portion by means of a compression spring.

* * * * *